US010160197B2

(12) United States Patent
Kamibayashi et al.

(10) Patent No.: US 10,160,197 B2
(45) Date of Patent: Dec. 25, 2018

(54) PRINTING APPARATUS AND PRINTING SYSTEM

(71) Applicant: SEIKO EPSON CORPORATION, Tokyo (JP)

(72) Inventors: Masashi Kamibayashi, Matsumoto (JP); Masako Fukuda, Shiojiri (JP); Hironori Sato, Matsumoto (JP); Naoki Kayahara, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/245,554

(22) Filed: Aug. 24, 2016

(65) Prior Publication Data

US 2017/0072707 A1 Mar. 16, 2017

(30) Foreign Application Priority Data

Sep. 15, 2015 (JP) ..... 2015-181705

(51) Int. Cl.

| | |
|---|---|
| ***B41J 2/205*** | (2006.01) |
| ***B41J 2/01*** | (2006.01) |
| ***B41J 2/21*** | (2006.01) |
| *B41J 11/00* | (2006.01) |
| *B41J 2/045* | (2006.01) |
| *B41M 5/00* | (2006.01) |

(52) U.S. Cl.

CPC ..... *B41J 2/01* (2013.01); *B41J 2/2054* (2013.01); *B41J 2/2114* (2013.01); *B41J 11/0015* (2013.01); *B41J 2/04501* (2013.01); *B41J 11/002* (2013.01); *B41M 5/0017* (2013.01)

(58) Field of Classification Search

CPC ..... B41J 2/01; B41J 11/0015; B41J 11/002; B41J 2/04501; B41J 2/2114; B41J 2/2054; B41M 5/0017

See application file for complete search history.

(56) References Cited

U.S. PATENT DOCUMENTS

2010/0328388 A1* 12/2010 Takekoshi ..... B41J 2/2139 347/14
2014/0092157 A1* 4/2014 Yoshida ..... B41J 2/2128 347/14
2014/0132662 A1* 5/2014 Katsuragi ..... B41J 11/0015 347/21

FOREIGN PATENT DOCUMENTS

JP 2005-007649 A * 1/2005 ..... B41J 2/01
JP 2005-22329 A 1/2005

* cited by examiner

*Primary Examiner* — Yaovi M Ameh
(74) *Attorney, Agent, or Firm* — Workman Nydegger

(57) ABSTRACT

A printing apparatus includes a liquid ejecting section that is capable of ejecting a reactant liquid and an ink, and a control section that controls operation of the liquid ejecting section. The control section sets an ejection duty of the reactant liquid according to an ejection duty of the ink.

3 Claims, 7 Drawing Sheets

PRINTING APPARATUS AND PRINTING SYSTEM

BACKGROUND

1. Technical Field

The present invention relates to a technique for ejecting a liquid such as an ink onto a medium.

2. Related Art

Ink jet printing apparatuses have been proposed that eject ink containing a colorant such as a pigment or dye onto various media, such as printing paper. For example, JP-A-2005-22329 describes a technique to improve the fixing properties of ink to a medium by ejecting a reactant liquid containing an aggregation agent together with the ink, such that the two mix together on the surface of the medium.

However, an issue exists in which the abrasion resistance of printed images actually falls if excessive reactant liquid is ejected with respect to the ejection amount of the ink. In particular, for example, in cases in which a non-absorbent medium formed from a material such as polyvinyl chloride is employed, the fall in abrasion resistance can become pronounced in a state in which there is a low ink ejection amount.

SUMMARY

An advantage of some aspects of the invention is that a fall in abrasion resistance as a result of excessive reactant liquid ejection is suppressed.

A printing apparatus of an aspect of the invention includes a liquid ejecting section that is capable of ejecting a reactant liquid and an ink, and a control section that controls operation of the liquid ejecting section. The control section sets an ejection duty of the reactant liquid according to an ejection duty of the ink. In the above aspect, the ejection duty of the reactant liquid is controlled according to the ejection duty of the ink. This thereby enables a fall in abrasion resistance as a result of excessive reactant liquid ejection to be suppressed.

In a preferable aspect of the invention, the control section sets the reactant liquid ejection duty according to the ink ejection duty such that the reactant liquid ejection duty is a second value when the ink ejection duty is a first value, and such that the reactant liquid ejection duty is a fourth value greater than the second value when the ink ejection duty is a third value greater than the first value. In the above aspect, the reactant liquid ejection duty is the second value when the ink ejection duty is the first value, and the reactant liquid ejection duty is the fourth value greater than the second value when the ink ejection duty is the third value greater than the first value. This thereby enables a fall in abrasion resistance to be suppressed, while maintaining print quality.

A printing apparatus according to a preferable aspect of the invention further includes a heating section that heats a medium on which the reactant liquid and the ink have landed. In the above aspect, the medium on which the reactant liquid and the ink have landed is heated by the heating section. Due to heating the medium with the heating section, the ejection amount of reactant liquid required to maintain print quality is reduced, thereby enabling a reduction in the amount of reactant liquid consumed, while satisfying both print quality and abrasion resistance.

In a preferable aspect of the invention, the liquid ejecting section is capable of ejecting the reactant liquid and the ink using plural ejection amounts including a first ejection amount and a second ejection amount greater than the first ejection amount. The control section controls the liquid ejecting section such that the reactant liquid is ejected using the first ejection amount. In the above aspect, the reactant liquid is ejected using the first ejection amount lower than the second ejection amount, thereby enabling a fall in abrasion resistance as a result of excessive reactant liquid ejection to be effectively suppressed.

A program according to another aspect of the invention is a program that causes a computer connected to, or installed in, a printing apparatus provided with a liquid ejecting section capable of ejecting a reactant liquid and an ink, to function as a control section that controls operation of the liquid ejecting section. The control section controls an ejection duty of the reactant liquid according to an ejection duty of the ink. In the above aspect, the ejection duty of the reactant liquid is controlled according to the ejection duty of the ink. This thereby enables a fall in abrasion resistance as a result of excessive reactant liquid ejection to be suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
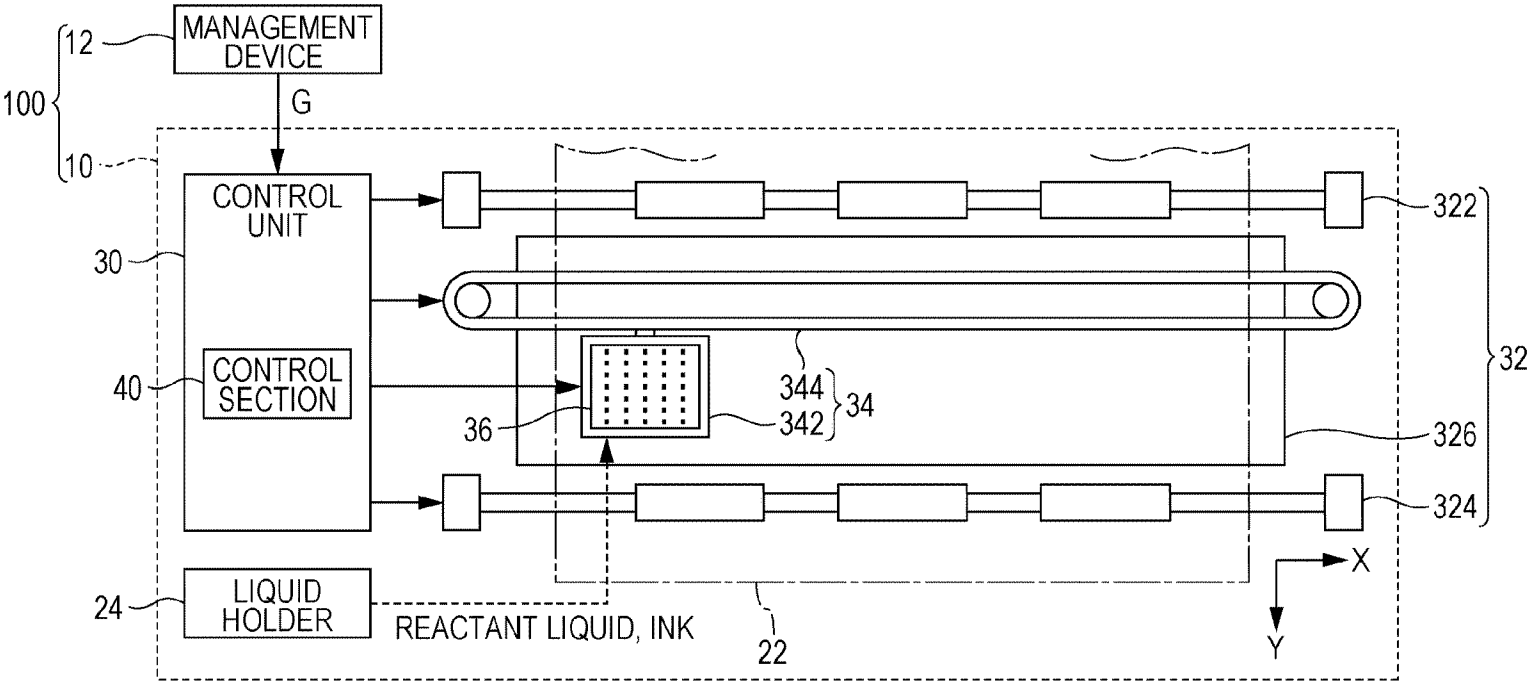
FIG. 1 is a configuration diagram of a printing system according to a first embodiment.

FIG. 1 is a configuration diagram of a printing system 100 according to a first embodiment of the invention. As illustrated in FIG. 1, the printing system 100 of the first embodiment includes a printing apparatus 10 and a management device 12 (host computer). The printing apparatus 10 is a liquid ejecting apparatus (ink jet apparatus) that prints images on a surface of a medium 22 by ejecting ink, this being an example of a liquid, onto the medium 22. The medium 22 is a recording medium such as printer paper or a film, serving as an ink ejection target. The first embodiment envisages a non-absorbent medium 22 formed from polyvinyl chloride. The management device 12 is, for example, implemented by an information processing device such as a personal computer, and controls operation of the printing apparatus 10 by sending various commands and image data G for printing to the printing apparatus 10.

As illustrated in FIG. 1, a liquid holder 24 that stores liquid is mounted to the printing apparatus 10. The liquid holder 24 stores reactant liquid and ink. The ink of the first embodiment is a liquid (colored ink) containing a colorant such as pigment or dye. For example, a total of four ink colors, these being cyan (C), magenta (M), yellow (Y), and black (K), are stored in the liquid holder 24. Note that the ink may contain resin material. The reactant liquid is a liquid (optimizer ink) that improves the fixing properties of the ink that has landed on the surface of the medium 22, and, for example, contains a reactive component such as an aggregation agent that reacts with the ink, and a solution component such as water or other solvent. For example, a polyvalent metal salt such as a magnesium salt (for example magnesium sulfate) is preferably employed as an aggregation agent in the reactant liquid. The colorant and resin material contained in the ink is not contained in the reactant liquid. Note that the reactant liquid may include a surfactant. For convenience, the liquid holder 24 is illustrated as a single element in FIG. 1. However, configuration may be made in which the reactant liquid is stored in a separate liquid holder 24 to the liquid holder 24 for plural types of ink, or configuration may be made in which plural types of ink are each stored in a separate liquid holder 24.

As illustrated in FIG. 1, the printing apparatus 10 of the first embodiment includes a control unit 30, a transport mechanism 32, a moving mechanism 34, and a liquid ejecting section 36. The control unit 30 includes, for example, control circuits such as a central processing unit (CPU) or a field programmable gate array (FPGA), and recording circuits such as semiconductor memory (not illustrated in the drawings). The control unit 30 performs overall control of the respective elements of the printing apparatus 10 according to commands from the management device 12. The control circuits execute programs stored in the recording circuits such that the control unit 30 of the first embodiment functions as a control section 40 that controls operation of the liquid ejecting section 36.

The transport mechanism 32 transports the medium 22 in a Y direction under the control of the control unit 30. The transport mechanism 32 of the first embodiment includes a feed roller 322, a discharge roller 324, and a medium retention section 326. The feed roller 322 and the discharge roller 324 transport the medium 22 in the Y direction. The medium retention section 326 is a flat plate shaped structural body (platen) on which the medium 22 being transported by the feed roller 322 and the discharge roller 324 is mounted. The medium 22 is transported across a surface of the medium retention section 326. Note that the structure of the transport mechanism 32 is not limited to the above example, and any configuration capable of transporting the medium 22 in the Y direction may be employed.

The moving mechanism 34 is a mechanism that moves the liquid ejecting section 36 back and forth in an X direction, under the control of the control unit 30. The X direction in which the liquid ejecting section 36 moves back and forth in a direction intersecting (typically orthogonal to) the Y direction in which the medium 22 is transported. The moving mechanism 34 of the first embodiment includes a carriage 342 that supports the liquid ejecting section 36, and a conveyor belt 344 provided spanning across in the X direction. The conveyor belt 344 circulates under the control of the control unit 30, thereby moving the liquid ejecting section 36 back and forth in the X direction together with the carriage 342. Note that the structure of the moving mechanism 34 is not limited to the above example, and any configuration capable of moving the liquid ejecting section 36 back and forth in the X direction may be employed. Moreover, the liquid holder 24 may be installed to the carriage 342, together with the liquid ejecting section 36.

The liquid ejecting section 36 is a liquid ejecting head that ejects the reactant liquid and the ink supplied from the liquid holder 24 onto the medium 22 under the control of the control unit 30. The liquid ejecting section 36 ejects the reactant liquid and ink onto the medium 22, in parallel with the transportation of the medium 22 by the transport mechanism 32 and the back and forth movement of the moving mechanism 34, so as to form a desired image on the surface of the medium 22.

Figure 2:
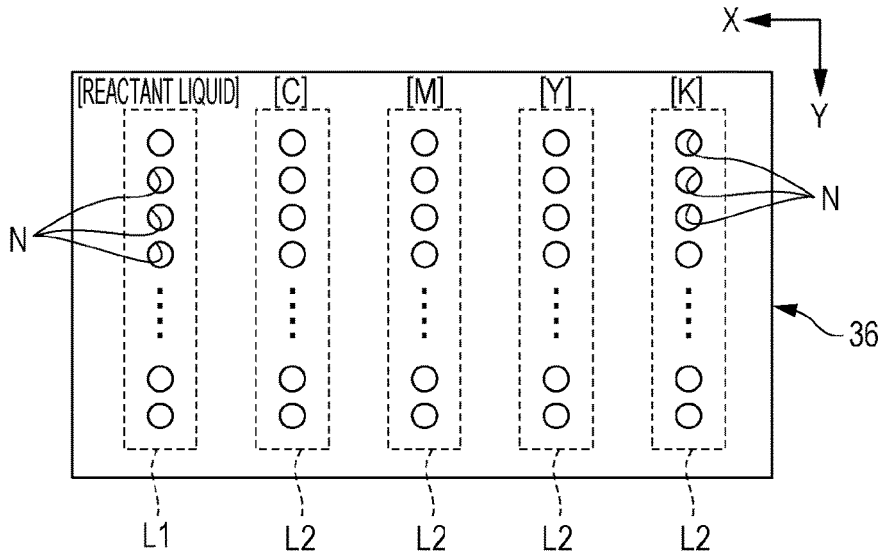
FIG. 2 is a plan view of an ejection face of a liquid ejecting section.

FIG. 2 is a plan view illustrating a face of the liquid ejecting section 36 that opposes the medium retention section 326 (medium 22) (referred to below as the "ejection face"). As illustrated in FIG. 2, a first nozzle row L1 and plural second nozzle rows L2 are provided on the ejection face of the liquid ejecting section 36 with intervals between each other in the X direction. Each of the first nozzle row L1 and the respective second nozzle rows L2 is a collection of plural nozzles N arrayed in a straight line along the Y direction. Note that each of the first nozzle row L1 and the respective second nozzle rows L2 may also be configured in plural rows (for example, in a zigzagging array or a staggered array).

The first nozzle row L1 is a collection of plural nozzles N that eject the reactant liquid supplied from the liquid holder 24 onto the medium 22. Each of the plural second nozzle rows L2 is a collection of plural nozzles N that eject ink supplied from the liquid holder 24 onto the medium 22. Specifically, as can be seen from FIG. 2, a different colored ink (C, M, Y, K) is ejected from the nozzles N of each of the respective second nozzle rows L2. The reactant liquid (aggregation agent) ejected from the respective nozzles N of the first nozzle row L1 and the ink ejected from the respective nozzles N of the second nozzle rows L2 react together on the surface of the medium 22, thereby suppressing localized ink aggregation (referred to below as "uneven aggregation"), and improving print quality. Note that the positions of the first nozzle row L1 and the plural second nozzle rows L2 are not limited to those of the above example. For example, the first nozzle row L1 may be disposed on a negative side in the Y direction (on a transportation upstream side of the medium 22) with respect to the plural second nozzle rows L2 (such that the ink lands on the medium 22 after the reactant liquid has landed on the medium 22).

Figure 3:
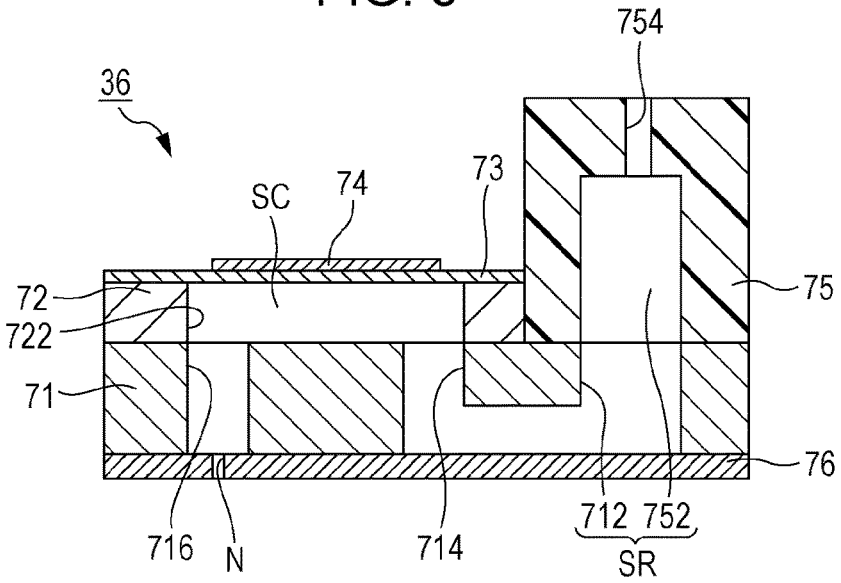
FIG. 3 is a cross-section of a liquid ejecting section.

FIG. 3 is a cross-section focusing on any given nozzle N of the liquid ejecting section 36. As illustrated in FIG. 3, the liquid ejecting section 36 is a stacked structural body in which a pressure chamber substrate 72, a diaphragm 73, piezoelectric elements 74, and a support body 75 are disposed on one side of a flow path substrate 71, and a nozzle plate 76 is disposed on the other side of the flow path substrate 71. The flow path substrate 71, the pressure chamber substrate 72, and the nozzle plate 76 are, for example, formed from flat silicon plate members. The support body 75 is, for example, formed by injection molding a resin material. The plural nozzles N are formed in the nozzle plate 76.

The flow path substrate 71 is formed with an opening portion 712, branched flow paths (restriction flow paths) 714 and communication flow paths 716. The branched flow paths 714 and the communication flow paths 716 are through holes formed for each of the respective nozzles N, and the opening portion 712 is an opening running continuously past the plural nozzles N. A space where both a housing portion (recess) 752 formed in the support body 75 and the opening portion 712 of the flow path substrate 71 are in communication with each other functions as a common liquid chamber (reservoir) SR that stores the reactant liquid or ink supplied from the liquid holder 24 through an entry flow path 754 in the support body 75.

The pressure chamber substrate 72 is formed with opening portions 722 corresponding to each of the respective nozzles N. The diaphragm 73 is an elastically deformable flat plate member disposed on a surface of the pressure chamber substrate 72 on the opposite side to the flow path substrate 71. Spaces interposed between the diaphragm 73 and the flow path substrate 71 at the inside of the opening portions 722 of the pressure chamber substrate 72 function as pressure chambers (cavities) SC that are filled with the reactant liquid or ink supplied from the common liquid chamber SR through the branched flow paths 714. Each pressure chamber SC is in communication with the corresponding nozzle N through the communication flow path 716 of the flow path substrate 71.

The piezoelectric elements 74 are formed for each of the respective nozzles N, on a surface of the diaphragm 73 on the opposite side to the pressure chamber substrate 72. Each piezoelectric element 74 is a drive element in which a piezoelectric body is interposed between mutually opposing electrodes. The piezoelectric element 74 deforms when supplied with drive signals, causing the diaphragm 73 to oscillate, such that the pressure inside the pressure chamber SC fluctuates, and the reactant liquid or ink inside the pressure chamber SC is ejected through the nozzle N. The above is a specific structure of the liquid ejecting section 36.

As described above, uneven aggregation is suppressed due to the ink reacting with the reactant liquid on the surface of the medium 22. However, there is a tendency for the abrasion resistance of the printed image to fall if excessive reactant liquid is ejected with respect to the amount of ejected ink. If the medium 22 employed is formed from polyvinyl chloride, as in the example of the first embodiment, the fall in abrasion resistance due to the reactant liquid becomes particularly evident. It is speculated that the cause of this fall in abrasion resistance may be, for example, due to the reactive component of the reactant liquid (aggregation agent) being present between the surface of the medium 22 and the resin material contained in the ink, reducing the adhesive force, or due to the strength of an ink film being reduced as a result of a reduction in ink density caused by the presence of the reactive component therein. As these explanations suggest, there is a tendency for the fall in abrasion resistance to become greater the greater the increase in the reactant liquid ejection amount with respect to the ink ejection amount.

In consideration of the above tendency, the control section 40 of the first embodiment controls an ejection duty $D_{Op}$ (Op: optimizer) of the reactant liquid according to an ejection duty $D_{Ink}$ of the ink in the liquid ejecting section 36. The ejection duties are each an index of an ejection amount per unit time per unit surface area of the medium 22, and are each expressed as ratio (%) with respect to specific reference values. Specific relationships between the ink ejection duty $D_{Ink}$ and the reactant liquid ejection duty $D_{Op}$ are described in detail below.

Figure 4:
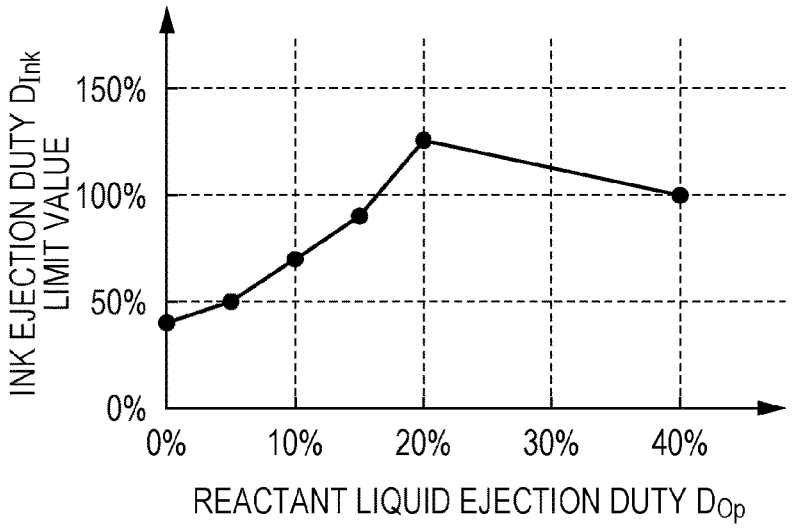
FIG. 4 is a graph illustrating a relationship between a reactant liquid ejection duty and limit values of an ink ejection duty.

FIG. 4 is a graph illustrating a relationship between the reactant liquid ejection duty $D_{Op}$ and limit values (upper limit values) of the ink ejection duty $D_{Ink}$ in order to secure a specific print quality. As described above, abrasion resistance falls the more the reactant liquid ejection amount increases with respect to the ink ejection amount. Accordingly, as can be seen from FIG. 4, in order to suppress a drop in abrasion resistance while maintaining the specific print quality, it is necessary to lower the reactant liquid ejection duty $D_{Op}$ the lower the ink ejection duty $D_{Ink}$.

Specifically, as the ink ejection duty $D_{Ink}$ falls compared to the reactant liquid ejection duty $D_{Op}$, the abrasion resistance falls, but there is also a tendency for uneven aggregation to decrease. Accordingly, as the ejection duty $D_{Ink}$ falls, priority is given to suppressing a fall in abrasion resistance by lowering the reactant liquid ejection duty $D_{Op}$. On the other hand, as the ink ejection duty $D_{Ink}$ gets higher compared to the reactant liquid ejection duty $D_{Op}$, the abrasion resistance rises, but there is also a tendency for uneven aggregation to be exacerbated. Accordingly, as the ejection duty $D_{Ink}$ becomes higher, priority is given to reducing uneven aggregation by raising the reactant liquid ejection duty $D_{Op}$.

Figure 5:
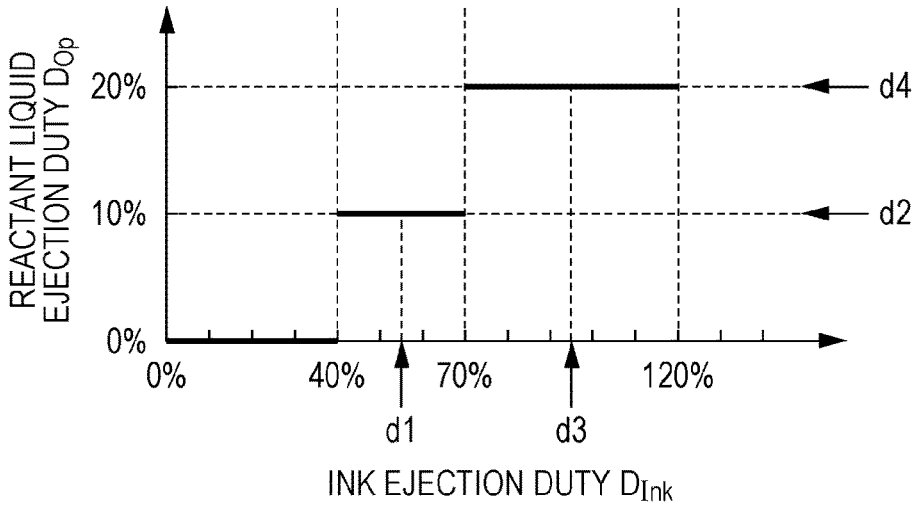
FIG. 5 is a graph illustrating a relationship between ink ejection duty and reactant liquid ejection duty.

As described above, the control section 40 of the first embodiment controls operation of the liquid ejecting section 36 so as to lower the reactant liquid ejection duty $D_{Op}$ as the ink ejection duty $D_{Ink}$ falls. FIG. 5 is an explanatory diagram to explain the reactant liquid ejection duties $D_{Op}$ that the control section 40 instructs the liquid ejecting section 36 with for various ejection duty $D_{Ink}$ values (horizontal axis). The relationship between the ejection duty $D_{Ink}$ and the ejection duty $D_{Op}$ in FIG. 5 is set in consideration of the tendencies illustrated in FIG. 4.

As illustrated in FIG. 5, the control section 40 sets the reactant liquid ejection duty $D_{Op}$ to 0% when the ejection duty $D_{Ink}$ is 40% or lower ($D_{Ink} \leq 40\%$). The control section 40 sets the ejection duty $D_{Op}$ to 10% when the ejection duty $D_{Ink}$ is a value from 40% up to 70% ($40\% < D_{ink} \leq 70\%$), and the control section 40 sets the ejection duty $D_{Op}$ to 20% when the ejection duty $D_{Ink}$ is a value from 70% up to 120% ($70\% \leq D_{Ink} \leq 120\%$).

FIG. 5 also draws attention to a value d1 (first value) and a value d3 (third value) that are possible values of the ink ejection duty $D_{Ink}$. The value d3 is greater than the value d1 (d3>d1). As illustrated in FIG. 5, the control section 40 controls the ejection duty $D_{Op}$ according to the ejection duty $D_{Ink}$, such that the reactant liquid ejection duty $D_{Op}$ is a value d2 (second value) when the ejection duty $D_{Ink}$ is the value d1, and the reactant liquid ejection duty $D_{op}$ is a value d4 (fourth value) greater than the value d2 (d4>d2) when the ejection duty $D_{Ink}$ is the value d3.

Figure 6:
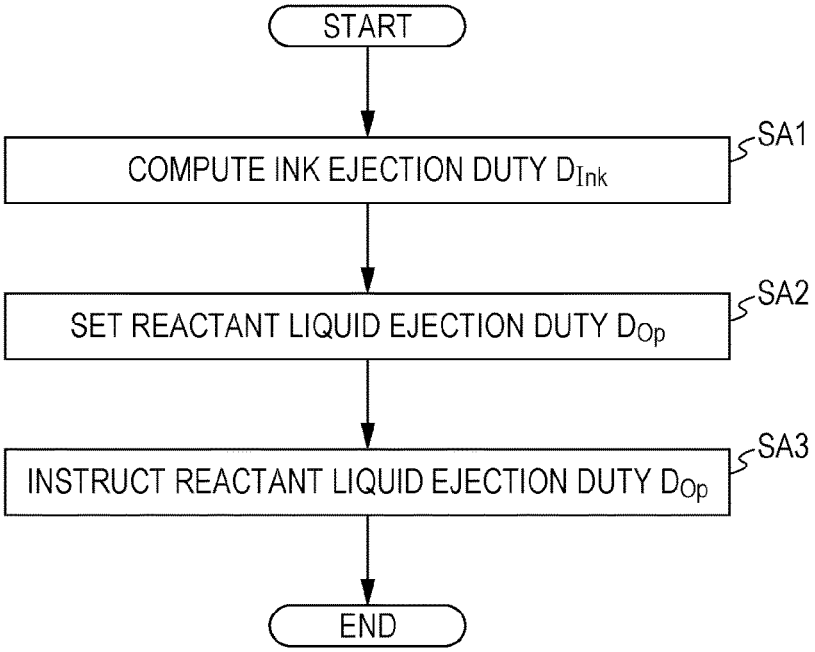
FIG. 6 is a flowchart of operation of a control section.

FIG. 6 is a flowchart illustrating operation of the control section 40. The processing in FIG. 6 is executed repeatedly at a specific time interval (for example, a time interval corresponding to one reciprocating motion of the liquid ejecting section 36 in the X direction). When the processing of FIG. 6 is started, the control section 40 computes the ink ejection duty $D_{Ink}$ for that time interval by analyzing image data G supplied from the management device 12 (SA1). Specifically, the ejection duty $D_{Ink}$ across all ink types can be computed according to respective ejection amounts computed for each of the plural ink types using the image data G.

When the ejection duty $D_{Ink}$ has been computed, the control section 40 sets the reactant liquid ejection duty $D_{Op}$ according to the ejection duty $D_{Ink}$ (SA2). Specifically, the control section 40 refers to a table of respective ejection duty $D_{Ink}$ values associated with respective ejection duty $D_{Op}$ values in order to identify the ejection duty $D_{OP}$ associated with the ejection duty $D_{Ink}$. The relationship between the ejection duty $D_{Ink}$ and the ejection duty $D_{Op}$ is as illustrated in FIG. 5. Note that, for example, the ejection duty $D_{Op}$ may also be computed by applying the ejection duty $D_{Ink}$ value to a specific formula expressing the relationship between the ejection duty $D_{Ink}$ and the ejection duty $D_{Op}$. When the ejection duty $D_{Op}$ has been set in the above manner, the control section 40 instructs the liquid ejecting section 36 with the ejection duty $D_{Op}$ (SA3).

As described above, in the first embodiment, the reactant liquid ejection duty $D_{Op}$ is set according to the ink ejection duty $D_{Ink}$. This thereby enables a fall in abrasion resistance resulting from excessive reactant liquid ejection to be suppressed. In particular, in the first embodiment, the ejection duty $D_{Op}$ is set according to the ejection duty $D_{Ink}$, such that the reactant liquid ejection duty $D_{Op}$ is the value d2 when the ejection duty $D_{Ink}$ is the value d1, and the reactant liquid ejection duty $D_{Op}$ is the value d4 greater than the value d2 when the ejection duty $D_{Ink}$ is the value d3 greater than the value d1. This thereby enables a fall in abrasion resistance to be suppressed, while maintaining print quality.

Second Embodiment

Explanation follows regarding a second embodiment of the invention. Note that in each of the embodiments described below, elements having similar operation and functions to those of the first embodiment are allocated the same reference numerals as in the description of the first embodiment, and detailed explanation thereof is omitted where appropriate.

Figure 7:
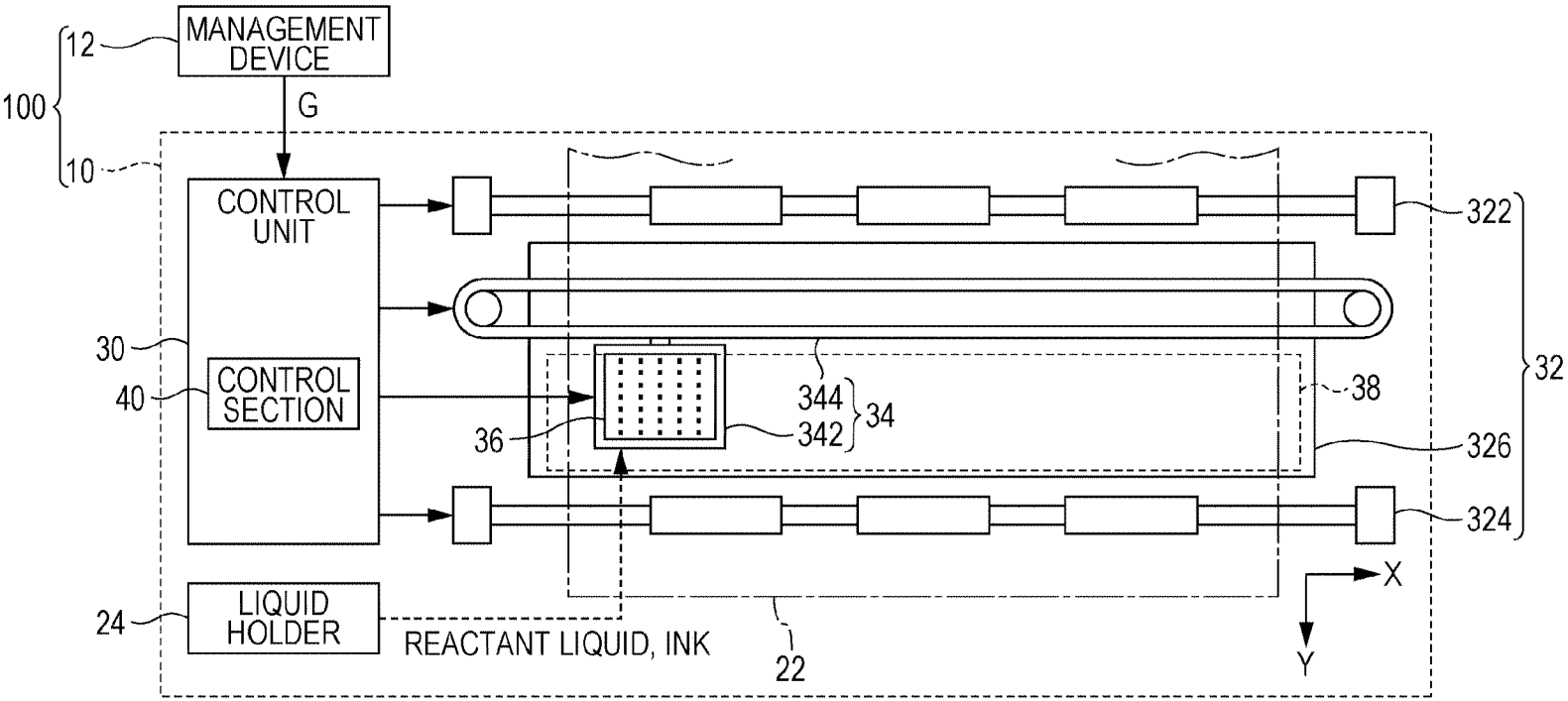
FIG. 7 is a configuration diagram of a printing system according to a second embodiment.

FIG. 7 is a configuration diagram of a printing system 100 of the second embodiment. As illustrated in FIG. 7, a printing apparatus 10 of the second embodiment includes a heating section 38 in addition to elements similar to those of the first embodiment. The heating section 38 is a heat generating body (heater) that generates heat using, for example, a heat source such as a heating wire disposed in the medium retention section 326. The heating section 38 heats the medium 22 on which the reactant liquid and ink from the liquid ejecting section 36 have landed. The heating of the medium 22 by the heating section 38 promotes drying of the reactant liquid and ink. Note that the structure of the heating section 38 is not limited to the example described above. For example, a mechanism that blows warm air onto the medium 22, or a mechanism that irradiates the medium 22 with electromagnetic waves such as infrared rays, may be employed as the heating section 38.

Figure 8:
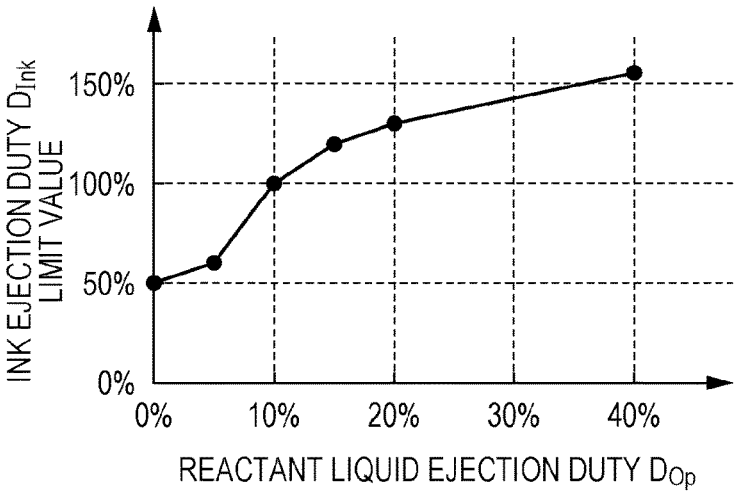
FIG. 8 is a graph illustrating a relationship between a reactant liquid ejection duty and limit values of an ink ejection duty in the second embodiment.

FIG. 8 is a graph illustrating a relationship between the reactant liquid ejection duty $D_{Op}$ and limit values of the ink ejection duty $D_{Ink}$ in order to secure a specific print quality in the second embodiment. As can be seen from FIG. 8, since drying of the reactant liquid and the ink is promoted by the heating section 38 in the second embodiment, the reactant liquid ejection amount needed to secure the specific print quality (the reactant liquid ejection duty $D_{Op}$ with respect to a given limit value of the ejection duty $D_{Ink}$) is reduced in comparison to the first embodiment (FIG. 4) in which the heating section 38 is not provided.

Figure 9:
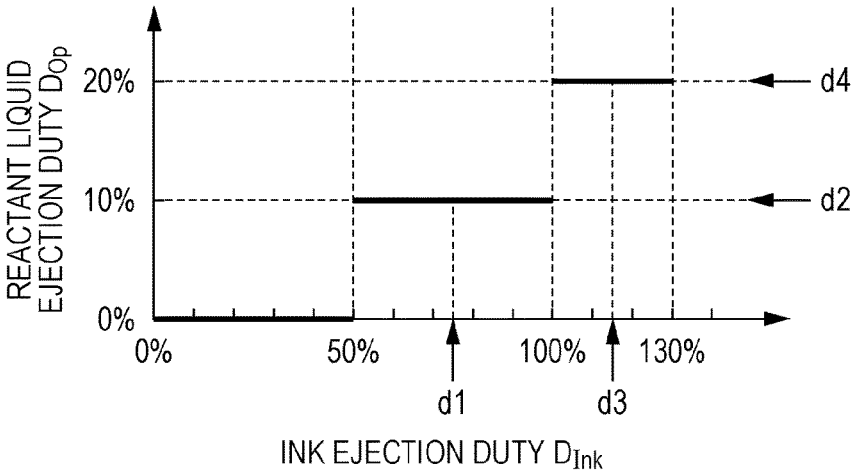
FIG. 9 is a graph illustrating a relationship between ink ejection duty and reactant liquid ejection duty in the second embodiment.

In consideration of the relationship illustrated in FIG. 8, in the second embodiment the ejection duty $D_{Op}$ is set according to the ejection duty $D_{ink}$ so as to satisfy the relationship between the ejection duty $D_{Ink}$ and the ejection duty $D_{Op}$ illustrated in FIG. 9. Specifically, the control section 40 sets the reactant liquid ejection duty $D_{Op}$ to 0% when the ejection duty $D_{Ink}$ is 50% or lower ($D_{Ink} \leq 50\%$). The control section 40 sets the ejection duty $D_{Op}$ to 10% when the ejection duty $D_{Ink}$ is a value from 50% up to 100% ($50\% < D_{Ink} \leq 100\%$), and the control section 40 sets the ejection duty $D_{Op}$ to 20% when the ejection duty $D_{Ink}$ is a value from 100% up to 130% ($100\% \leq D_{Ink} < 130\%$). As illustrated in FIG. 9, the relationship in which the reactant liquid ejection duty $D_{Op}$ is the value d2 when the ejection duty $D_{Ink}$ is the value d1, and the reactant liquid ejection duty $D_{Op}$ is the value d4 (d4>d2) when the ejection duty $D_{Ink}$ is the value d3 (d3>d1), is similar to that of the first embodiment.

The second embodiment obtains similar advantageous effects to the first embodiment. Moreover, in the second embodiment, the ejection amount of the reactant liquid required to maintain print quality is reduced due to heating the medium 22 with the heating section 38. This thereby enables the amount of the reactant liquid consumed to be reduced, while satisfying both print quality and abrasion resistance.

Third Embodiment

Explanation follows regarding a third embodiment of the invention. A liquid ejecting section 36 of the third embodiment is capable of ejecting the reactant liquid and ink using plural types of ejection amount, including an ejection amount QS (first ejection amount) and an ejection amount QL (second ejection amount). The ejection amount QL is greater than the ejection amount QS (QL>QS). Specifically, the ejection amount QL corresponds to large dots, and the ejection amount QS corresponds to small dots. A control section 40 of the third embodiment controls the liquid ejecting section 36 so as to eject the reactant liquid using the ejection amount QS (small dots). Note that the heating section 38 described in the second embodiment is not provided in the third embodiment.

Figure 10:
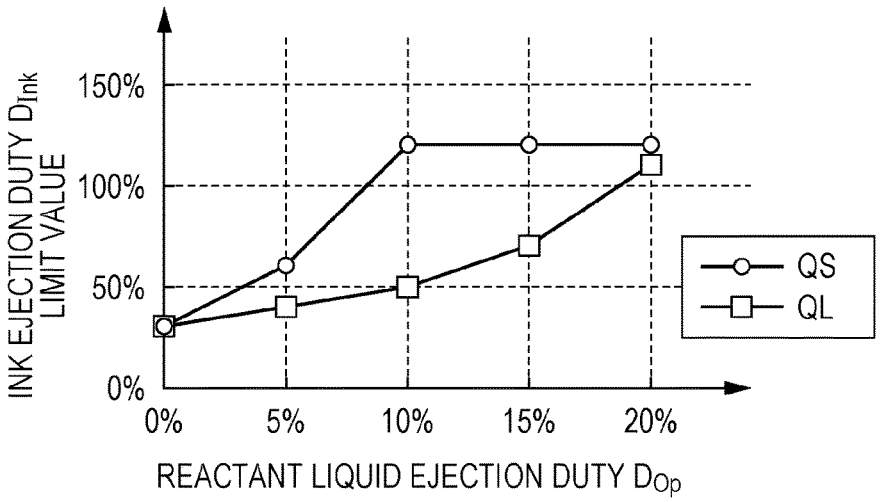
FIG. 10 is an explanatory diagram of ink ejection duty limit values in a third embodiment.

FIG. 10 is a graph illustrating a relationship between the reactant liquid ejection duty $D_{Op}$ and limit values of the ink ejection duty $D_{Ink}$ in order to secure a specific print quality. In FIG. 10, characteristics for when the reactant liquid is ejected using the ejection amount QS and characteristics for when the reactant liquid is ejected using the ejection amount QL are shown together. As can be seen from FIG. 10, when the reactant liquid is ejected using the ejection amount QS, the limit values of the ink ejection duty $D_{Ink}$ with respect to the reactant liquid ejection duty $D_{Op}$ can be increased in comparison to cases in which the reactant liquid is ejected using the ejection amount QL. Accordingly, in the third embodiment, the ejection amount of the reactant liquid is reduced while securing a sufficient ink ejection duty $D_{Ink}$ and maintaining print quality, thereby enabling a fall in abrasion resistance resulting from excessive reactant liquid ejection to be effectively suppressed.

Modified Examples

Various modifications may be made to the respective embodiments described above. Explanation follows regarding specific modifications. Any two or more selected from the following may be combined as appropriate within a range in which they do not contradict each other.

Figure 11:
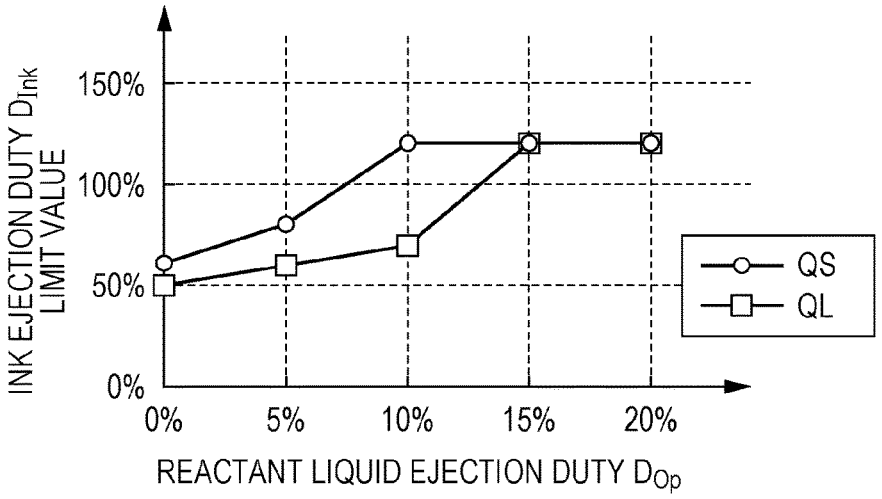
FIG. 11 is an explanatory diagram of ink ejection duty limit values in a modified example.

(1) The heating section 38 of the second embodiment may be applied to a configuration (the third embodiment) in which the liquid ejecting section 36 is capable of ejecting reactant liquid and ink using plural types of ejection amount, including the ejection amount QS and the ejection amount QL, as in the third embodiment. FIG. 11 is a graph illustrating a relationship between the reactant liquid ejection duty $D_{Op}$ and limit values of the ink ejection duty $D_{Ink}$ in order to secure a specific print quality in a configuration provided with the heating section 38. Similarly to in FIG. 10, in FIG. 11 characteristics when the reactant liquid is ejected using the ejection amount QS and characteristics when the reactant liquid is ejected using the ejection amount QL are shown together.

As can be seen by comparing FIG. 11 against FIG. 10, in a configuration provided with the heating section 38, the ink ejection duty $D_{Ink}$ has increased limit values when the reactant liquid is ejected using the ejection amount QL (large dots). This thereby enables a sufficient ink ejection duty $D_{Ink}$ to be secured, and print quality to be maintained, even when the reactant liquid is ejected using the ejection amount QL.

(2) The structure of the liquid ejecting section 36 may be modified as appropriate. For example, the respective embodiments described above give the example of the piezoelectric type liquid ejecting section 36 employing the piezoelectric elements 74 that apply mechanical oscillation to the pressure chamber SC. However, a heat type liquid ejecting section employing heat generating elements that generate air bubbles inside the pressure chambers by heating may also be employed.

(3) The respective embodiments described above use the example of the serial type printing apparatus 10 that moves the carriage 342 installed with the liquid ejecting section 36 back and forth in the X direction. However, the invention may also be applied to a line type printing apparatus in which plural nozzles N are distributed across the entire width direction of the medium 22. The printing apparatus 10 given as an example in the respective embodiments described above may also be employed in various devices such as fax machines and copy machines, as well as in dedicated printing machines.

(4) The respective embodiments described above give an example of a configuration in which the control section 40 is installed in the printing apparatus 10. However, the control section 40 may be implemented by the management device 12 connected to the printing apparatus 10. As is understood from the above explanation, a program (printer driver) according to a preferable aspect of the invention is a program that causes a computer (control unit 30, management device 12) connected to, or installed with, the printing apparatus 10 provided with the liquid ejecting section 36 capable of ejecting a reactant liquid and an ink, to function as the control section 40 that controls the operation of the liquid ejecting section 36. The control section 40 controls the reactant liquid ejection duty $D_{Op}$ according to the ink ejection duty $D_{Ink}$.

The program in the above example may be provided in a format stored on a computer-readable storage medium and installed to a computer. A storage medium is, for example, a non-transitory storage medium, of which a preferable example is an optical storage medium (optical disk) such as a CD-ROM. However, the storage media encompass any known format, such as semiconductor storage media or magnetic storage media. The program in the above example may also be provided in a format distributed through a communication network and installed to a computer.

The entire disclosure of Japanese Patent Application No. 2015-181705, filed Sep. 15, 2015 is expressly incorporated by reference herein in its entirety.

What is claimed is:

1. A printing apparatus comprising:

a liquid ejecting section that is capable of ejecting a reactant liquid and an ink; and a control section that controls operation of the liquid ejecting section;

wherein the control section sets an ejection duty of the reactant liquid according to an ejection duty of the ink, each ejection duty being an index of an ejection amount per unit surface area of a medium to which the reactant liquid or ink is ejected, wherein the control section controls operation of the liquid ejecting section so that ink is ejected with plural types of ejection amounts including a first ejection amount that produces a first dot of a first size and a second ejection amount that is greater than the first ejection amount and that produces a second dot of a second size that is larger than the first size and the reactant liquid is ejected with the first ejection amount, wherein the control section sets the reactant liquid ejection duty according to the ink ejection duty and controls operation of the liquid ejecting section so that:

the reactant liquid ejection duty by using the first ejection amount is a second value when the ink ejection duty by using the first ejection amount and the second ejection amount is a first value; and the reactant liquid ejection duty by using the first ejection amount is a fourth value greater than the second value when the ink ejection duty by using the first ejection amount and the second ejection amount is a third value greater than the first value.

2. The printing apparatus of claim 1, further comprising a heating section that heats a medium on which the reactant liquid and the ink have landed.

3. A program that causes a computer connected to, or installed in, a printing apparatus provided with a liquid ejecting section capable of ejecting a reactant liquid and an ink, to function as a control section that controls operation of the liquid ejecting section, wherein:

the control section controls an ejection duty of the reactant liquid according to an ejection duty of the ink, each ejection duty being an index of an ejection amount per unit surface area of a medium to which the reactant liquid or ink is ejected, wherein the control section controls operation of the liquid ejecting section so that ink is ejected with plural types of ejection amounts including a first ejection amount that produces a first dot of a first size and a second ejection amount that is greater than the first ejection amount and that produces a second dot of a second size that is larger than the first size and the reactant liquid is ejected with the first ejection amount, wherein the control section sets the reactant liquid ejection duty according to the ink ejection duty and controls operation of the liquid ejecting section so that:

the reactant liquid ejection duty by using the first ejection amount is a second value when the ink ejection duty by using the first ejection amount and the second ejection amount is a first value; and the reactant liquid ejection duty by using the first ejection amount is a fourth value greater than the second value when the ink ejection duty by using the first ejection amount and the second ejection amount is a third value greater than the first value.

* * * * *